US008072153B2

(12) United States Patent
Liu

(10) Patent No.: US 8,072,153 B2
(45) **Date of Patent: *Dec. 6, 2011**

(54) MULTI-COLOR BACKLIGHT CONTROL CIRCUIT AND MULTI-COLOR BACKLIGHT CONTROL METHOD

(75) Inventor: Jing-Meng Liu, Jubei (TW)

(73) Assignee: Richtek Technology Corporation R.O.C. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/004,293

(22) Filed: Jan. 11, 2011

(65) Prior Publication Data

US 2011/0109234 A1 May 12, 2011

Related U.S. Application Data

(62) Division of application No. 11/851,569, filed on Sep. 7, 2007, now Pat. No. 7,893,626.

(51) Int. Cl.
*H05B 37/00* (2006.01)

(52) U.S. Cl. ..... 315/185 R; 315/192; 315/193

(58) Field of Classification Search ..... 315/191, 315/193, 195, 185 R, 186
See application file for complete search history.

(56) References Cited

U.S. PATENT DOCUMENTS

| | | | | |
|---|---|---|---|---|
| 7,569,996 | B2 * | 8/2009 | Holmes et al. | 315/291 |
| 7,741,788 | B2 * | 6/2010 | Ito et al. | 315/247 |
| 2005/0225515 | A1 | 10/2005 | Tsuchida | |
| 2008/0054815 | A1 * | 3/2008 | Kotikalapoodi et al. | 315/192 |

FOREIGN PATENT DOCUMENTS

| | | | |
|---|---|---|---|
| CN | 1656621 | A | 8/2005 |
| KR | 2006/47027 | | 5/2006 |
| KR | 2007/77719 | A | 7/2007 |
| KR | 10-2006-0012692 | | 8/2007 |
| WO | WO 03/103061 | A1 | 12/2003 |

* cited by examiner

*Primary Examiner* — David Hung Vu
(74) *Attorney, Agent, or Firm* — Tung & Associates

(57) ABSTRACT

The present invention discloses a multi-color backlight control circuit, comprising: a plurality of pins for electrically connecting with a plurality of LED strings of different LED colors; and a voltage supply circuit for receiving an input voltage and supplying a single output voltage to the plurality of LED strings of different LED colors. The present invention also discloses a multi-color backlight control method, comprising: supplying a single output voltage to a plurality of LED strings of different LED colors.

21 Claims, 12 Drawing Sheets

MULTI-COLOR BACKLIGHT CONTROL CIRCUIT AND MULTI-COLOR BACKLIGHT CONTROL METHOD

This is a Divisional of a application Ser. No. 11/851,569, filed on Sep. 7, 2007 now U.S. Pat. No. 7,893,626.

FIELD OF INVENTION

The present invention relates to a multi-color backlight control circuit, and a multi-color backlight control method.

BACKGROUND OF THE INVENTION

In a liquid crystal display (LCD), a backlight control circuit is employed to control light emitting diodes (LEDs) to illuminate from the back side of the liquid crystal display, which enables a user to observe an image from the front side of the liquid crystal screen.

According to state of the art, there are two types of arrangements for the backlight LED structure, one of which employs single-color white LEDs, and the other of which employs red, green and blue (RGB) LEDs. The latter is referred to in this specification as "multi-color backlight", and the control circuit thereof is referred to as "multi-color backlight control circuit". Single-color white LED backlight requires a less sophisticated control circuit, but the "white" light generated is not true white light; it is actually a synthetic light having less light quality by exciting fluorescence powders by blue LEDs. On the other hand, white light obtained by mixing the lights from R, G and B LEDs has better light quality. However, regardless whether the white backlight is obtained from white LEDs or from R, G and B LEDs, the light has to pass through color filters in the LCD, and whatever portion of the light not consistent with the color of the filters is filtered out. In other words, there is energy loss and the photo energy is not utilized to the best.

A so-called "color sequential technique" is proposed to deal with the above issue, in which the R, G and B LEDs sequentially emit light in correspondence with the pixels of the same color in the LCD, so no color filters are used. The technique saves power, but requires a more sophisticated control circuit. Thus, a multi-color backlight control circuit adapted to this color sequential technique becomes very important and is very much desired.

More specifically, the operational voltages of the R, G and B LEDs are different. In general, a white LED has an operational voltage of about 3.2V-3.8V; a red LED has an operational voltage of about 1.9V-2.6V; a green LED has an operational voltage of about 2.9V-3.7V; a blue LED has an operational voltage of about 3.0V-3.8V. In the application of LCD backlight, it requires to connect a considerable number of LEDs in series, and therefore the supplied voltages for strings of LEDs of different colors are greatly different, probably more than 15 volts in a practical application. Hence as shown in FIG. 1, the prior art arrangement provides three backlight control circuits 10R, 10G and 10B to supply three different voltages Vout(R), Vout(G) and Vout(B), for controlling the brightness and power efficiency of R, G and B LEDs respectively. The three backlight control circuit may be integrated in one circuit chip, but it still requires to duplicate three voltage supply circuits and corresponding feedback control circuits.

The prior art structure is apparently not optimum. Thus, it is desired to provide a more efficient multi-color backlight control circuit with simpler hardware structure and lower cost.

SUMMARY

In view of the foregoing, it is an objective of the present invention to provide a multi-color backlight control circuit with simpler hardware structure.

It is another objective of the present invention to provide a multi-color backlight control method.

In accordance with the above and other objectives, and in one aspect of the present invention, a multi-color backlight control circuit comprises: a plurality of pins for electrically connecting with a plurality of LED strings of different LED colors; and a voltage supply circuit for receiving an input voltage and supplying a single output voltage to the plurality of LED strings of different LED colors. The language "supplying a single output voltage" means "supplying one output voltage at a given time point"; the supplied voltage can vary at different time points according to feedback detection.

The plurality of LED strings of different LED colors which are electrically connected with the multi-color backlight control circuit include at least two LED strings having different number of LEDs.

According to the present invention, the total number of LEDs of each color is the same as that of another color, or the illumination time periods in which the LEDs of different colors emit light are different for different colors, or the current amounts passing through the LEDs of different colors are different.

In another aspect of the present invention, a backlight control circuit comprises: a plurality of pins for electrically connecting with a plurality of LED strings; and a voltage supply circuit for receiving an input voltage and supplying a single output voltage to the plurality of LED strings, wherein the numbers of LEDs in at least two LED strings are different.

The backlight control circuit in the preceding paragraph can be a single-color or a multi-color backlight control circuit.

In another aspect of the present invention, a multi-color backlight control method comprises: supplying a single output voltage to a plurality of LED strings of different LED colors. The language "supplying a single output voltage" means "supplying one output voltage at a given time point"; the supplied voltage can vary at different time points according to feedback detection.

Similar to the above, the total number of LEDs of each color can be made the same as that of another color, or the illumination time periods in which the LEDs of different colors emit light can be made different for different colors, or the current amounts passing through the LEDs of different colors can be made different, in the method according to the present invention.

These and other objectives, features, aspects, functions and advantages of the present invention can be better understood from the description of preferred embodiment with reference to the accompanying drawings.

DESCRIPTION OF THE PREFERRED EMBODIMENTS

Figure 1:
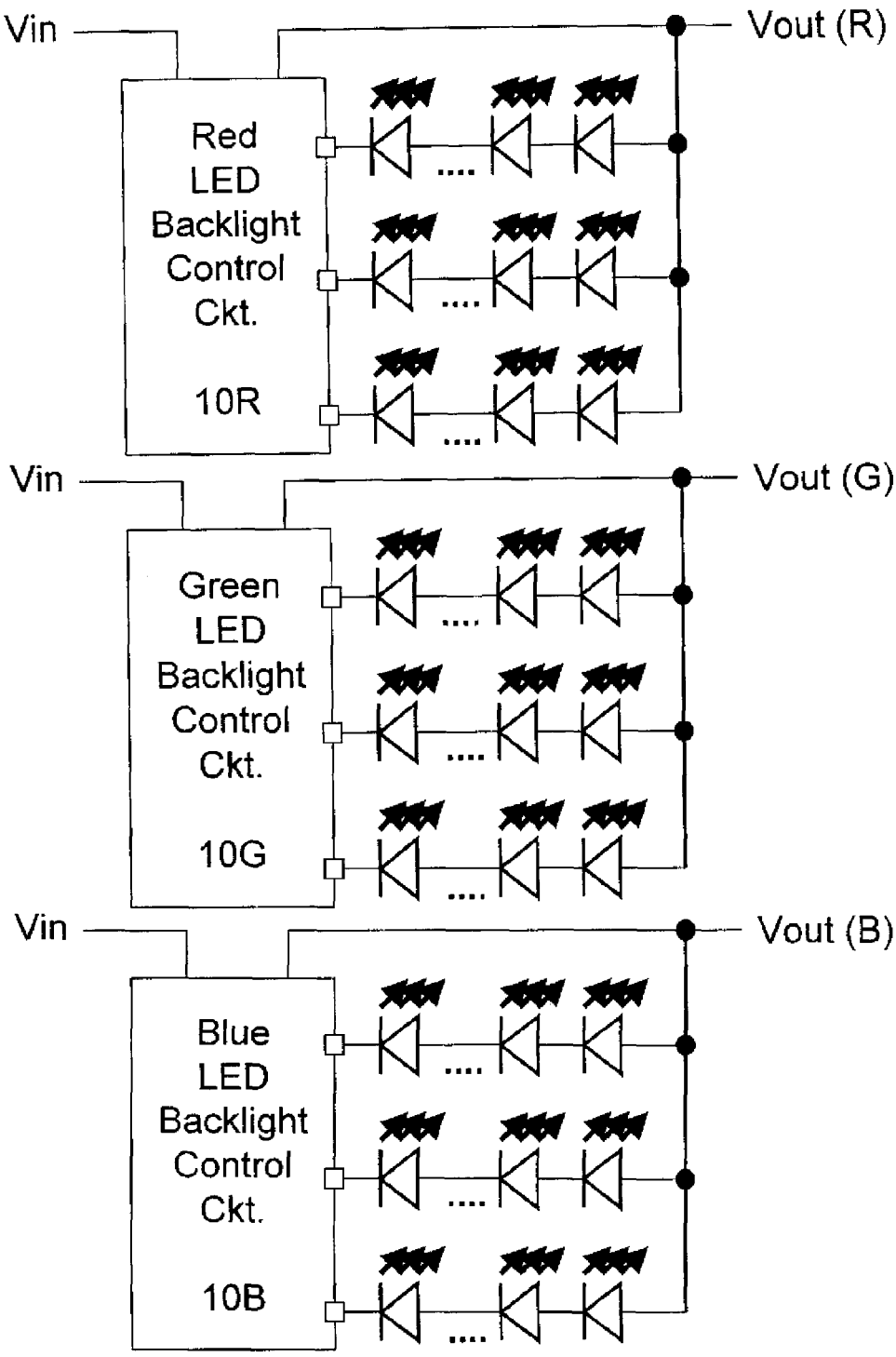
Fig. 1 (Prior Art)
FIG. 1 is a schematic circuit diagram showing a prior art control circuit.
Figure 2:
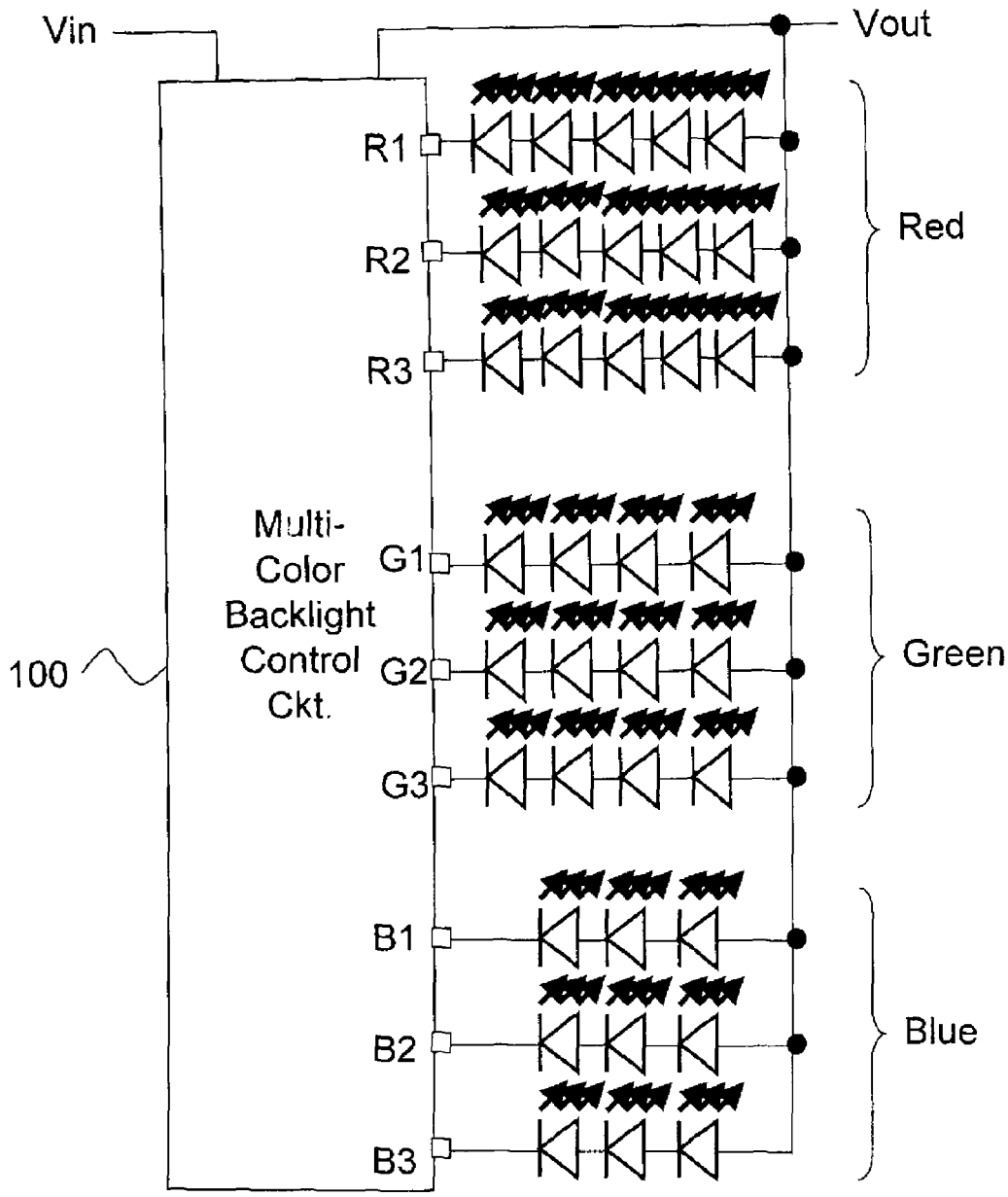
FIG. 2 is a diagram showing a preferred embodiment of the present invention, which supplies voltage to strings of LEDs of different colors by one single multi-color backlight control circuit.

Referring to FIG. 2, the present invention only provides a single output voltage Vout, so it only requires a single multi-color backlight control circuit 100. The multi-color backlight control circuit 100 has a plurality of pins for connecting with strings of LEDs of different colors. Three pins for each color (R1-R3, G1-G3, and B1-B3) are shown in the figure for illustration, but the actual number of the pins need not be the same as the illustrative number. The output voltage Vout is equal to or slightly larger than a lowest common multiple of the operational voltages of the R, G and B LEDs. Correspondingly, the numbers of LEDs in the R, G and B LED strings are different, so that each LED string requires a similar voltage, that is, all of the LED strings can be connected to and operate under the same supplied voltage Vout. For illustrative purpose, the numbers of LEDs in the R, G and B LED strings are shown to be 5, 4 and 3, respectively, to symbolically express that their numbers are different; the actual numbers should be decided according to product requirement. In one embodiment, the number of red LEDs is 15, and that of the green LEDs and that of the blue LEDs are both 10; the output voltage Vout is 36 volts, assuming that the operational voltages of the green LEDs and the blue LEDs are similar and the trivial difference between them can be neglected. It is alright if the output voltage Vout is slightly higher than the voltage required by the LED strings, as long as it does not exceed a risky upper limit; although the power utilization efficiency is slightly lowered, the LEDs can still operate normally.

Under the arrangement of the FIG. 2, since the numbers of LEDs of R, G and B LED strings are different, it is required to balance the brightness of the LEDs. According to one embodiment of the present invention, the total number of LEDs of each color is arranged to be the same as or close to that of another color, by adjusting the number of the strings of each color. For example, assuming that the number of red LEDs is 15 in each string, and that of the green LEDs and that of the blue LEDs are both 10 in each string, the numbers of the strings of R, G and B LEDs can be 2, 3 and 3 respectively, so that the total number of LEDs of each color is the same, 30.

Figure 3:
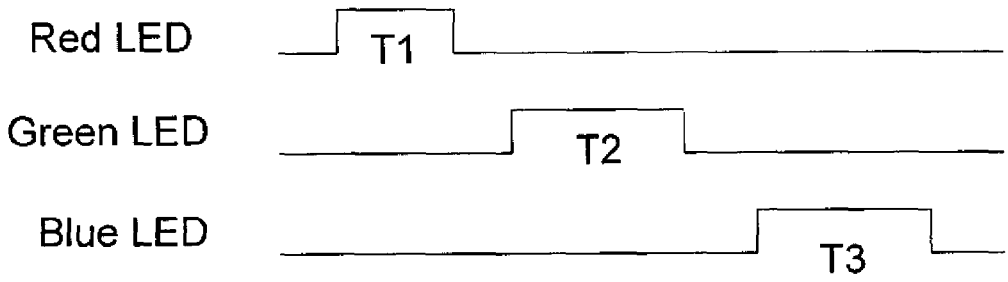
FIG. 3 is a preferred embodiment wherein LEDs of different colors emit light for different periods of time.
Figure 3:
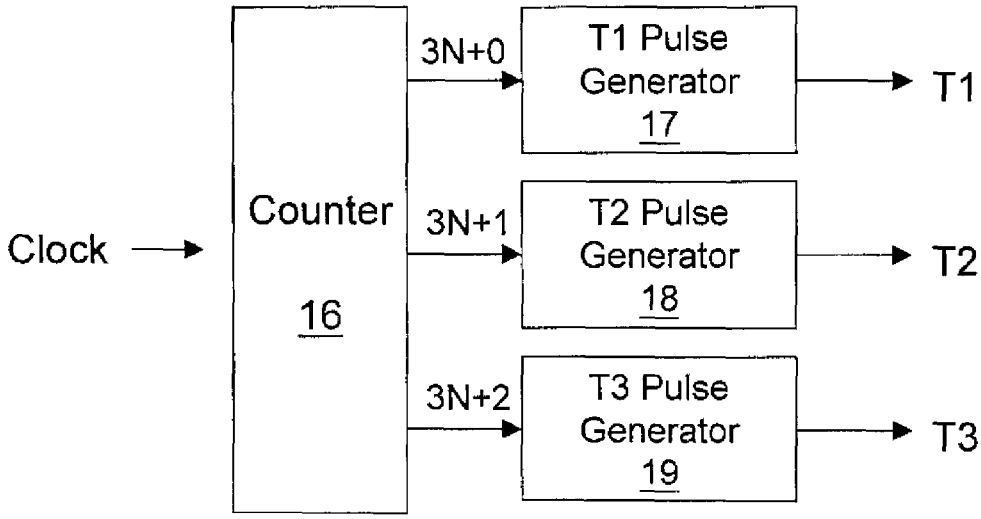

In addition to modifying the number of the strings, the total number of the R, G and B LEDs can be kept different, while their illumination time periods are controlled to compensate the difference in number. For example, assuming that the ratio between the numbers of R, G and B LEDs is 3:2:2, then the corresponding illumination time periods can be 2:3:3, so that the visual effect of each color is the same or similar. Referring to FIG. 3, the illumination time periods of the R, G and B LEDs are T1, T2 and T3 respectively, with a ratio 2:3:3. The periods of the pulses T1, T2 and T3 can be generated by providing a counter 16 and three pulse generators 17, 18 and 19, wherein the counter 16 sequentially triggers the pulse generators 17, 18 and 19 according to clock signals, to generate the pulses T1, T2 and T3. The clock signals can be obtained from an external circuit to the multi-color backlight control circuit 100 (such as from an LCD controller), or a clock generator within the multi-color backlight control circuit 100. In some applications, after LEDs of each color emit light for one turn, there is a dark period wherein all of the LEDs are OFF to eliminate visual residual effect. In this case, a fourth pulse generator (not shown), or even more pulse generators can be provided to generate the dark period, and the counter 16 should sequentially triggers the pulse generators 17, 18 and 19 and the fourth (or more) pulse generator.

Figure 4:
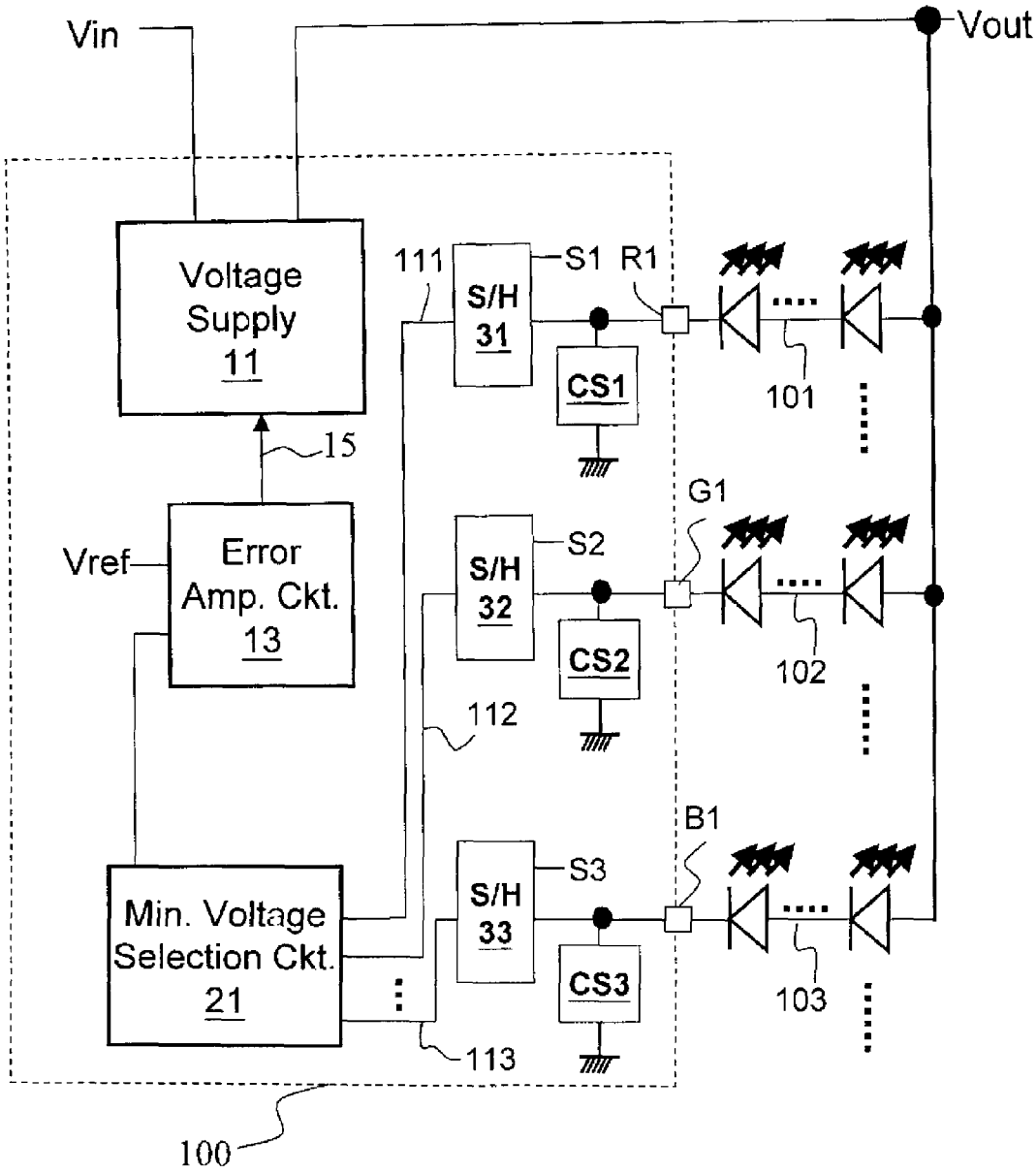
FIG. 4 is a schematic circuit diagram showing the detailed structure of a multi-color backlight control circuit according to an embodiment of the present invention.
Figure 5:
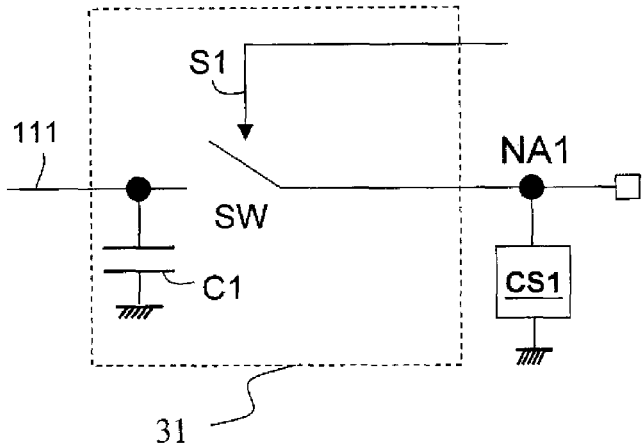
FIG. 5 shows an example of the sample-and-hold circuit.

In addition to controlling the illumination time, according to another embodiment, the present invention controls the current amounts passing through the LEDs of different colors, so that the LEDs of different colors generate the same or similar brightness, while the total number of the R, G and B LEDs are different. FIG. 4 shows this embodiment, in which only one LED string for each color is shown in the figure for simplicity. In the multi-color backlight control circuit 100 of this embodiment, current sources CS1-CS3 are provided to respectively control the current amounts passing through the LED strings of different LED colors. Sample-and-hold (S/H) circuits 31-33 respectively sample and hold voltages of corresponding nodes. The S/H circuits 31-33 are respectively controlled by signals S1-S3. By way of example, FIG. 5 shows the detailed structure of the S/H circuit 31, when the signal S1 closes the switch SW, the S/H circuit 31 samples the voltage at the corresponding node NA1, and when the switch SW is opened, the voltage is stored in the capacitor C1.

Referring back to FIG. 4, the minimum voltage selection circuit 21 selects the lowest voltage from the outputs 111-113 of the S/H circuits 31-33, and transmits the selected voltage to an error amplifier circuit 13 to compare it with a reference voltage Vref. A control signal 15 is generated based on the comparison, and the signal 15 is sent to a voltage supply circuit 11 to generate the desired output voltage Vout. The purpose to select the lowest voltage is to ensure that the output voltage Vout satisfies the requirement of every LED path, such that the current source on every LED path operates normally. The voltage supply circuit 11 for example can be a boost converter, a buck converter, a buck-boost converter, a flyback converter, or the like.

In order to prevent the output voltage Vout from unlimitedly increasing, an over voltage protection circuit can be provided to protect the multi-color backlight control circuit. Such over voltage protection circuit has been realized in conventional single-color white LED backlight control circuit, and therefore the details thereof are omitted.

Figure 6:
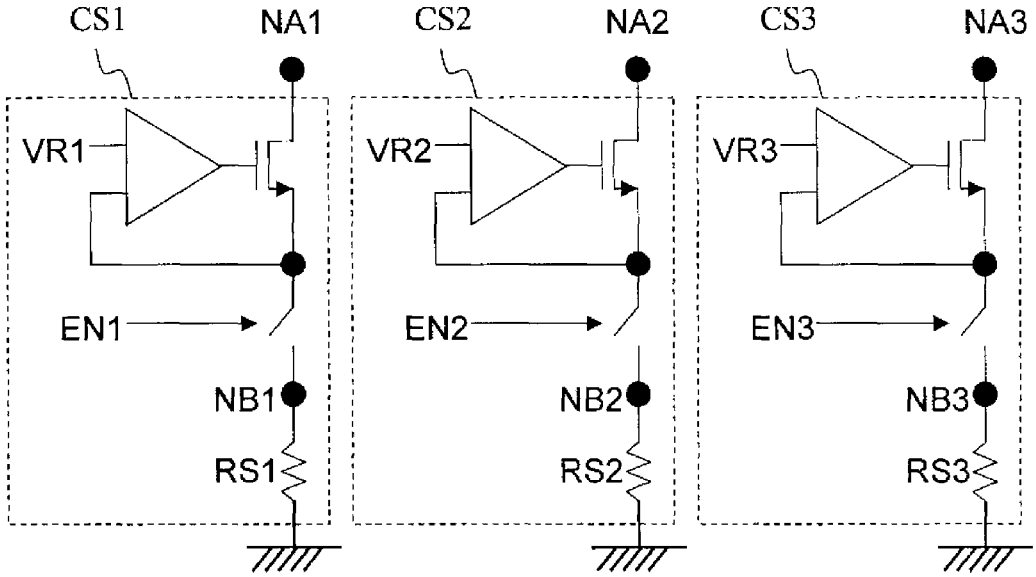
FIG. 6 shows an example of the current source circuit.
Figure 7:
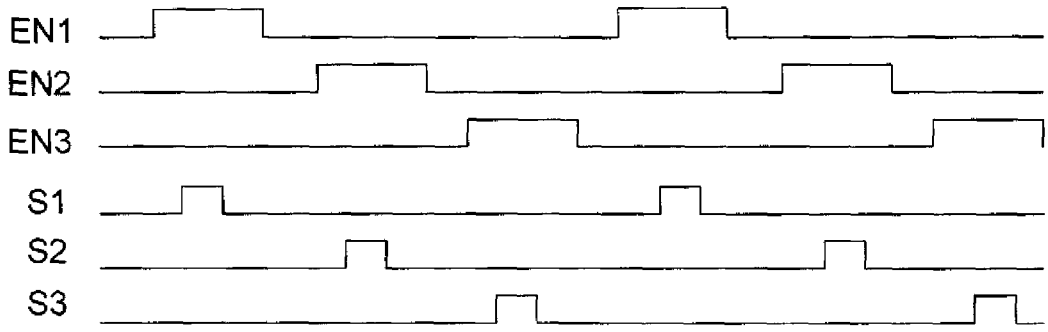
FIG. 7 shows the waveforms of the enable signals EN1-EN3 and the signals S1-S3 and their interrelationships.

FIG. 6 illustrates the detailed structure of the current sources CS1-CS3. As shown in the figure, besides the basic current source structure, the current sources CS1-CS3 are further controlled by corresponding enable signals EN1-EN3; the current sources CS1-CS3 operate only when the enable signals EN-EN3 turn ON the corresponding switches. The enable signals EN-EN3 have waveforms as shown in FIG. 7, to sequentially enable the current sources CS1-CS3 so that the LEDs of corresponding colors emit light in turn. The figure also shows the relationship between the enable signals EN-EN3 and the signals S1-S3 in the S/H circuits 31-33; after the enable signals EN-EN3 enables the corresponding current sources CS1-CS3, the signals S1-S3 triggers the S/H circuits 31-33 to store the voltages at the corresponding nodes.

Each of the current sources CS1-CS3 controls an LED path of a different color, so that different amounts of current pass through LED strings of different colors, to balance the brightness of the LEDs. The current amounts of the current sources CS1-CS3 can be set by:

1) setting the reference voltages VR1, VR2 and VR3;
2) setting the resistances RS1, RS2 and RS3; or
3) both of the above.

One can use any of the above approaches to set the brightness of the LEDs.

Figure 8:
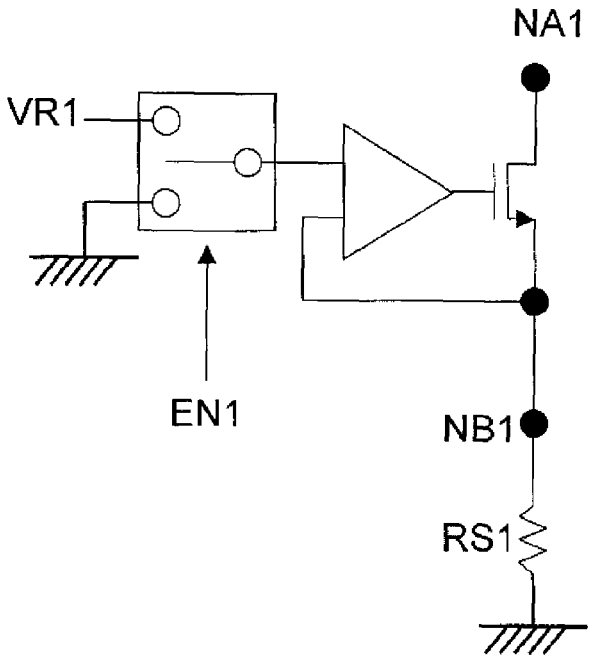
FIG. 8 shows another example of the current source circuit.

The structure of the current source is not limited to what is shown in FIG. 6; for example, it can be made of a bipolar transistor. The enable signal can be applied in a different manner, an alternative of which is shown in FIG. 8. The sampling nodes of the S/H circuit 31-33 are not limited to NA1-NA3, but can be the nodes NB1-NB3 instead. All of the above should belong to the scope of the present invention.

In the multi-color backlight control circuit 100 of FIG. 4, if there is any failure in an LED path so that no current or only very low current passing through the path (e.g., if a pin is misconnected, grounded, or if an LED in the path is burned out to open the path), the voltage supply circuit 11 will keep increasing the output voltage Vout. To avoid this, the circuit 100 can be equipped with under circuit detection (UCD) circuits 41-43. The UCD circuits 41-43 may be provided at the locations as shown in the figure, between the S/H circuits 31-33 and the minimum voltage selection circuit 21, or between the S/H circuits 31-33 and their corresponding current sources CS1-CS3. When "no current" or "very low current" condition does not occur, the UCD circuits 41-43 allow the minimum voltage selection circuit 21 to receive signals 111-113. When anyone or more LED paths have no current or very low current, the UCD circuits 41-43 exclude the corresponding signals 111-113 so that they are not valid inputs to the minimum voltage selection circuit 21, and thus the output voltage Vout will not be kept increasing.

Figure 10:
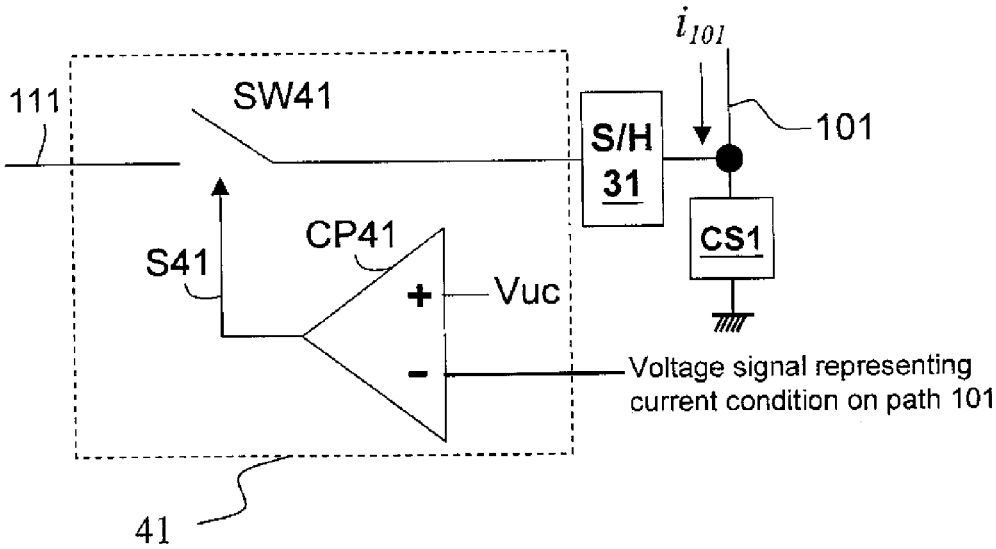
FIG. 10 is a schematic circuit diagram showing the under current detection (UCD) circuit.

The foregoing concept can be understood more clearly with reference to FIG. 10, which shows the UCD circuit 41 as an example. The current condition $i_{101}$ on the LED path 101 is converted to a voltage signal, and compared with a preset reference voltage Vuc. The comparison result is represented by a signal S41 which controls a switch SW41 so that when "no current" or "very low current" condition occurs in the path 101, the switch SW41 is opened. (Of course, depending on the design of the switch SW41, the output of the comparator CP41 may need to be inverted.) Note that FIG. 10 is only an example for illustrating the concept; the switch need not necessarily be located in the path 111, as long as the desired effect (to exclude the signal from the inputs of the minimum voltage selection circuit 21) can be achieved.

Figure 11:
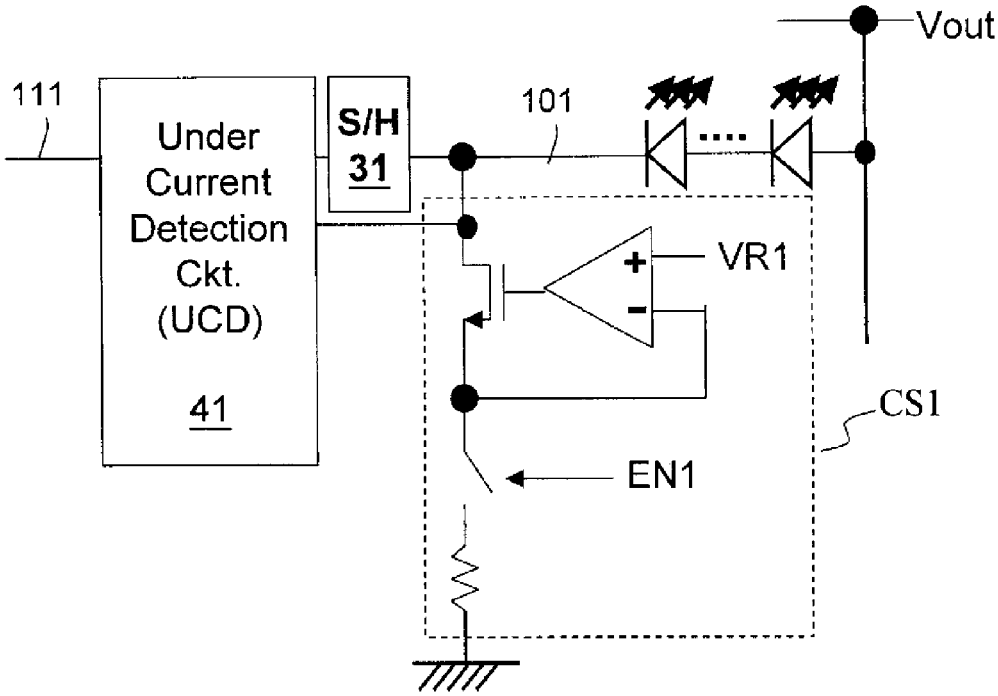
FIGS. 11 and 12 show two examples of the UCD circuit and how it is connected to the other circuits.
Figure 12:
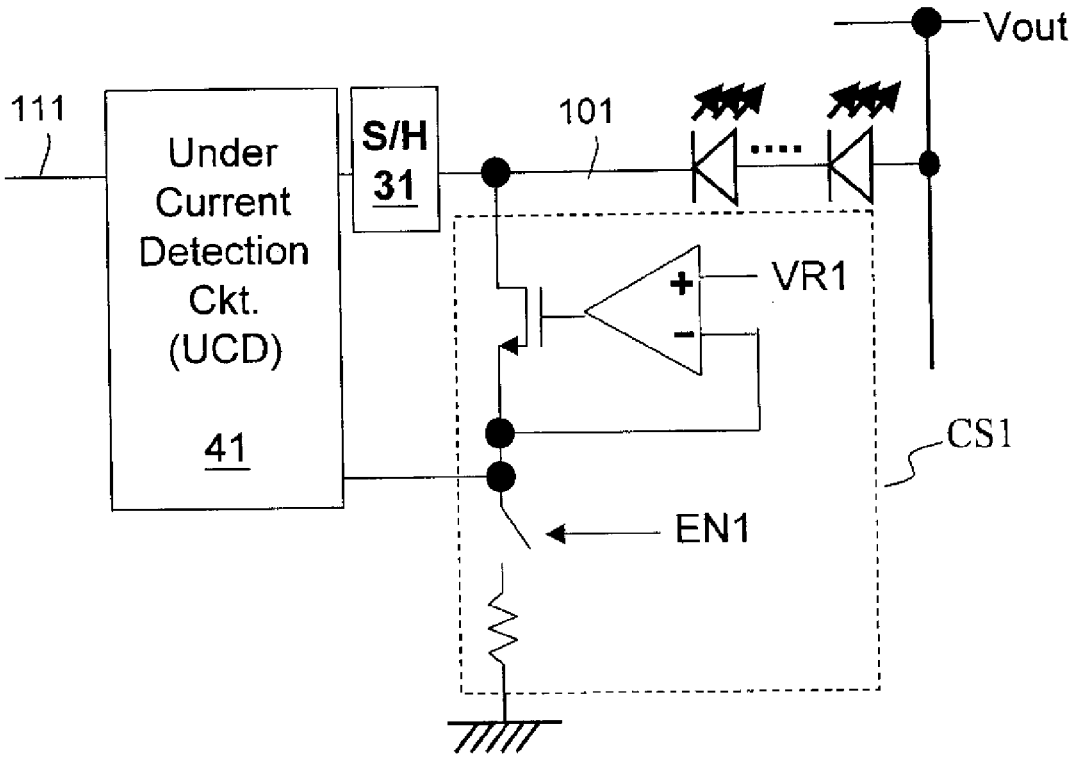

There are many ways to convert the current condition on the LED path 101 into a voltage signal; here are two examples. Referring to FIG. 11, if the current source CS1 is made of an NMOSFET, the drain voltage signal of the transistor can be extracted and sent to the UCD circuit 41 to be compared with a preset reference voltage Vuc. Or as shown in FIG. 12, the source voltage signal of the transistor can be extracted and sent to the UCD circuit 41 to be compared with a preset reference voltage Vuc. Depending on the location for extracting voltage, the value of the reference voltage Vuc should be correspondingly set to properly detect whether "no current" or "very low current" condition occurs in the path 101.

In addition to the above, the same effect can be achieved by detecting the voltage at one or more nodes in an external portion of the LED path outside the multi-color backlight control circuit 100, but it is less preferred because an additional pin is required. However, this variation should still fall in the scope of the present invention.

Under the circumstance where the UCD circuits are provided, it is possible that none of the signals 111-113 are valid inputs to the minimum voltage selection circuit 21 during circuit initialization stage, because there is no current on all of the LED paths. Thus the voltage supply circuit 11 might not be initialized to supply power. To avoid this malfunction, several approaches are described below for example.

Figure 13:
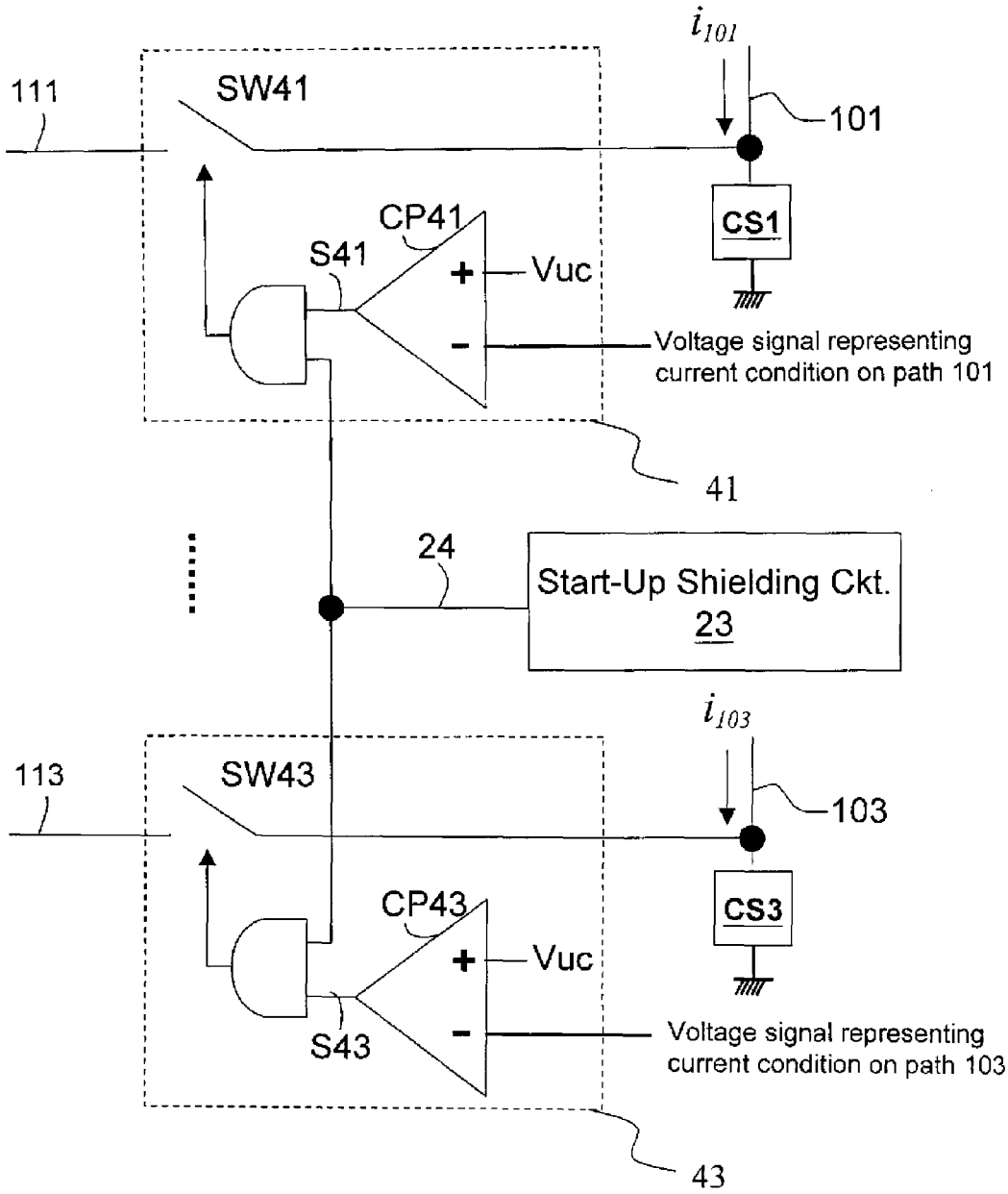
FIG. 13 shows an example of the start-up shielding circuit.

First, during circuit initialization stage, the UCD circuits 41-43 can be shielded based on a signal relating to circuit initialization, such as the power on reset signal or the soft start signal, so that the UCD circuits 41-43 do not send out the signals S41-S43, or the signals S41-S43 are sent out but neglected within a start-up period from the start of circuit initialization. This period can be terminated by a signal which is typically generated after the circuit initialization stage is over (such as the end signal of the soft start signal), by counting a fixed duration of time by a counter, or by monitoring whether the output voltage Vout exceeds a predetermined value (which can be done by one comparator). FIG. 13 shows an embodiment wherein a start-up shielding circuit 23 generates a shielding signal 24 according to any of the above or other methods, to shield the signals S41-S43 of the UCD circuits 41-43 during the start-up period, and to recover the functions of the signals S41-S43 after the start-up period is over. Note that the logic AND gate is only an example; the shielding function can be achieved by any suitable method. In addition, the shielding signal 24 need not shield all of the signals S41-S43, but instead can shield only one or several of them.

Figure 14:
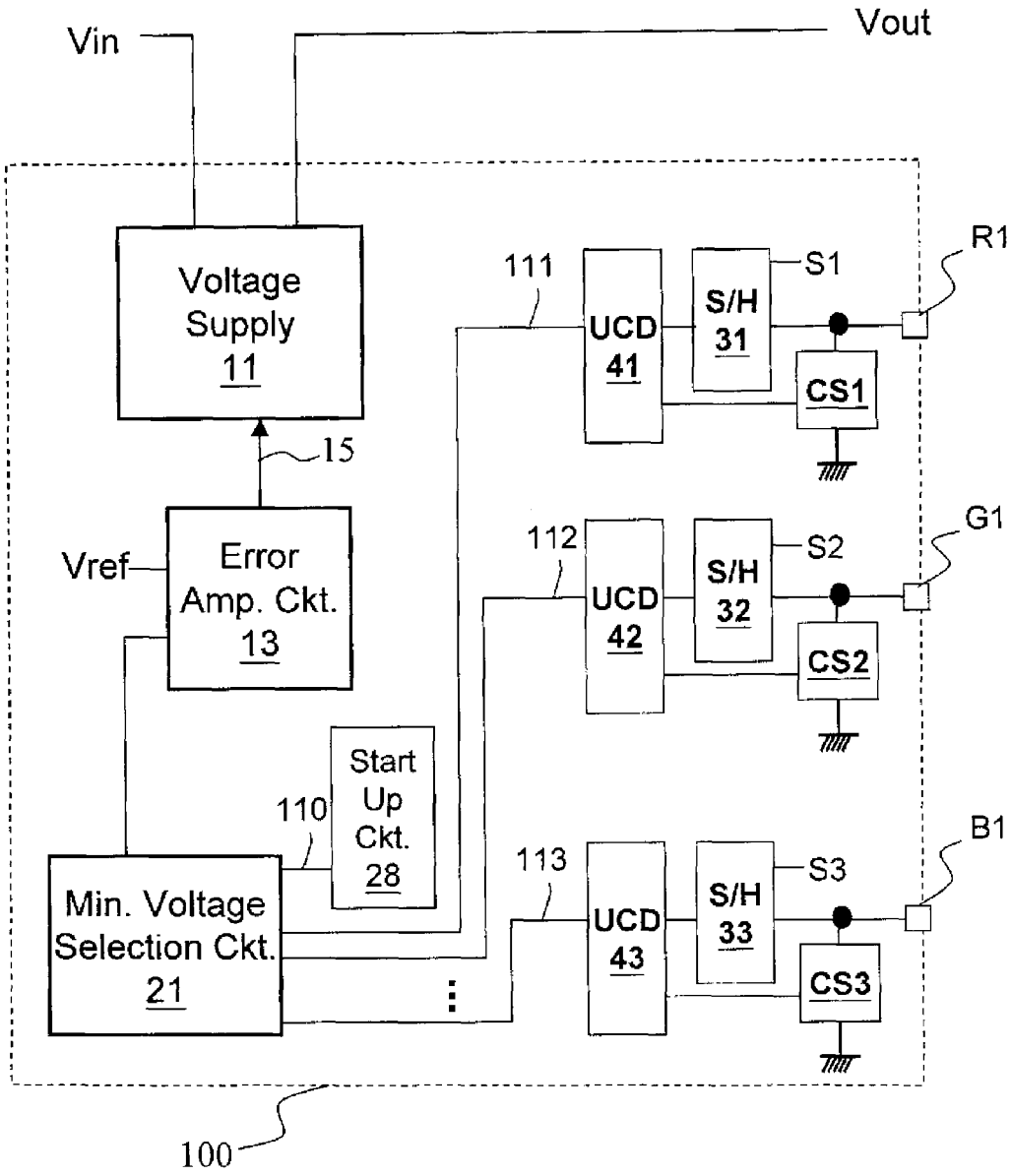
FIG. 14 shows how to ensure start-up by a start-up circuit.

Referring to FIG. 14, the malfunction issue can alternatively be solved by providing a start-up circuit. In this embodiment, the minimum voltage selection circuit 21 includes an additional input receiving the output from the start-up circuit 28. The purpose of the start-up circuit 28 is to provide the minimum voltage selection circuit 21 with a valid input 110 when all of the other inputs 111-113 are cut off. The valid input is compared with the reference voltage Vref in the error amplifier circuit 13 to generate a valid signal 15, so that the voltage supply circuit 11 can begin to supply power. Thus, the start-up circuit 28 should be able to generate a voltage signal lower than the reference voltage Vref when all of the other inputs 111-113 are cut off, so that the error amplifier circuit 13 can generate the signal 15, while it should also be able not to produce any substantial effect when the overall circuit has entered normal operation. There are many ways to do so; for example, the signal 110 can be generated from a dividend voltage of the output voltage Vout, or, the signal 110 can be a short period of 0 volt at the beginning of circuit initialization, and later switched to a high voltage level. There are many other variations which are omitted here.

Figure 9:
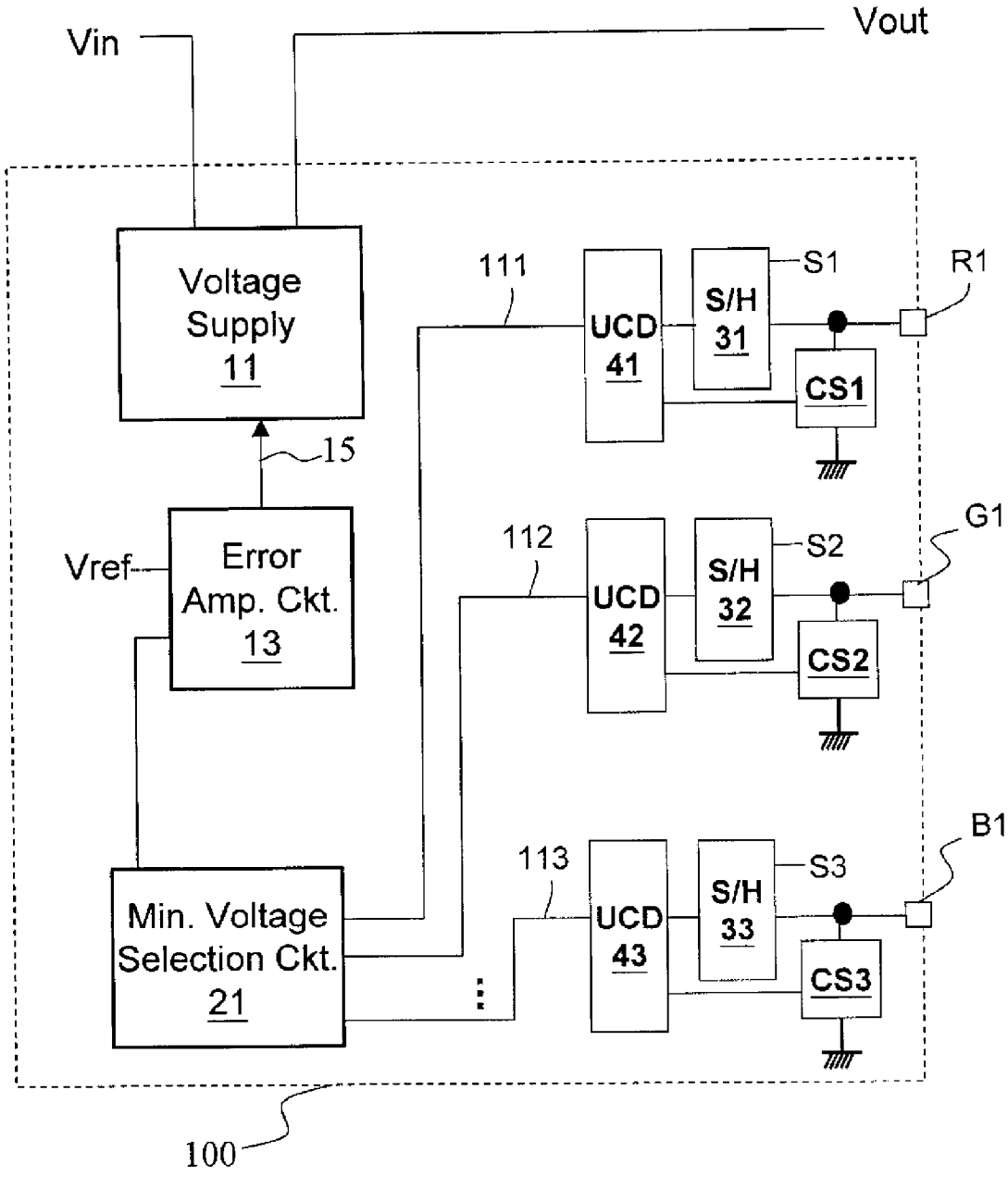
FIG. 9 is a schematic circuit diagram showing the detailed structure of a multi-color backlight control circuit according to another embodiment of the present invention.
Figure 15:
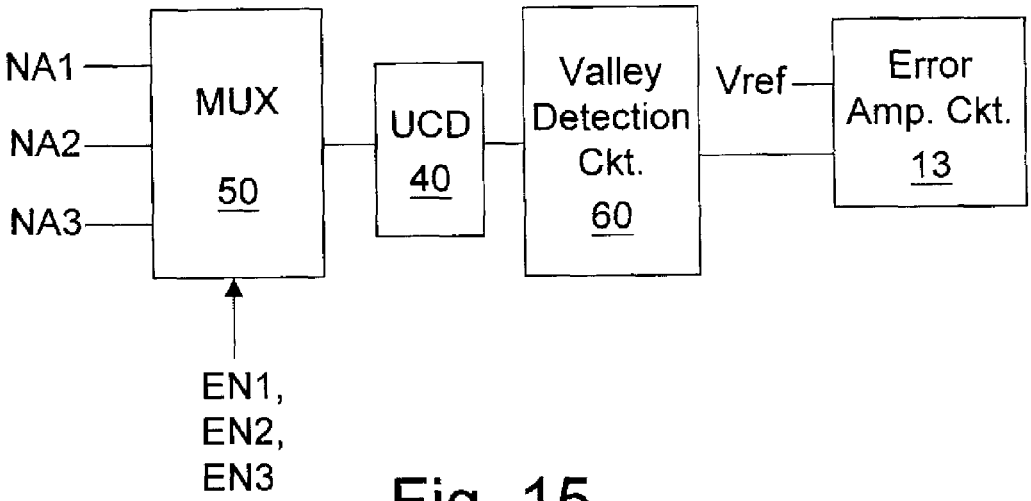
FIG. 15 is a schematic circuit diagram showing yet another embodiment of the present invention.

In the embodiments of FIGS. 4, 9 and 14, the S/H circuits 31-33 are used to store corresponding voltages, and the minimum voltage selection circuit 21 selects the lowest of the outputs 111-113 to compare it with the reference voltage Vref. This is not the only way to embody the present invention. Referring to FIG. 15 which shows another embodiment, a multiplexer circuit (MUX) 50 is provided which selects one of the nodes NA1-NA3 according to the enable signals EN-EN3, and inputs the voltage at the selected node to a valley detection circuit 60. The valley detection circuit 60 is capable of keeping the lowest voltage within a period of time, and therefore the output of the valley detection circuit 60 represents the lowest voltage of the nodes NA1-NA3, which also serves the purpose to select the lowest voltage. Likely, for safety reason, an UCD circuit 40 is preferably provided; the UCD circuit 40 can be provided at the right side of the MUX 50 as shown, or at the left side of the MUX 50. In short, the minimum voltage selection circuit 21 selects the lowest voltage among multiple parallel inputs within a given time point, while the valley detection circuit 60 selects the lowest voltage among multiple serial inputs within a time period. Either way, or even both, belong to the scope of the present invention.

Figure 16:
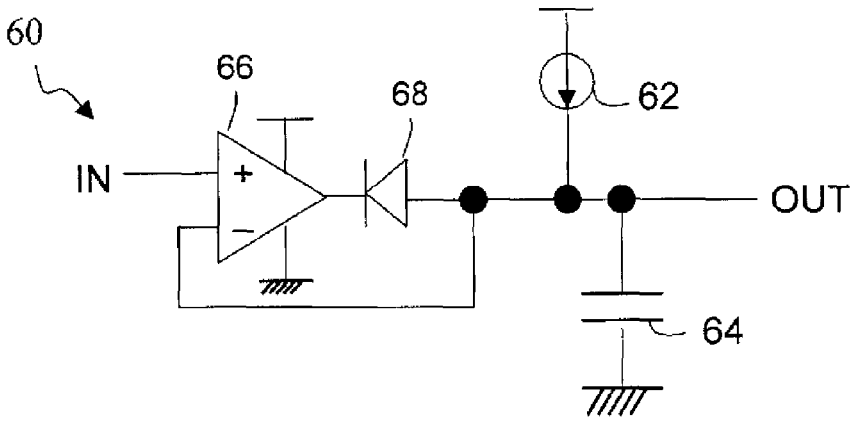
FIG. 16 shows an example of the valley detection circuit.

FIG. 16 shows an example of the detailed structure of the valley detection circuit 60, wherein a small current source 62 (i.e., providing small amount of current) slowly charges a capacitor 64. When the voltage across the capacitor 64 is higher than the input voltage IN, the capacitor 64 discharges through the operational amplifier 66 until its voltage drops to the input voltage IN. Thus, the output voltage shall keep the lowest input voltage.

The present invention has been described in considerable detail with reference to certain preferred embodiments thereof; these embodiments are for illustrative purpose and not for limiting the scope of the invention. Various other substitutions and modifications will occur to those skilled in the art, without departing from the spirit of the present invention. For example, the present invention is not limited to a backlight control circuit for R, G, and B LEDs, but instead can be applied to a white LED backlight control circuit, or a multi-color backlight control circuit of other colors such as red, yellow and cyan. As another example, a circuit which does not affect the primary meaning of a signal, such as a delay circuit, can be disposed between two devices shown to be in direction connection with each other in the forgoing embodiments. As a further example, the so-called "backlight" control circuit can be applied to control not only the backlight for an LCD, but also other illumination devices. Therefore, all modifications and variations based on the present invention should be interpreted to fall within the scope of the following claims and their equivalents.

What is claimed is:

1. A backlight control circuit, comprising:

a plurality of pins for electrically connecting with a plurality of LED strings; and a voltage supply circuit for receiving an input voltage and supplying a single output voltage to the plurality of LED strings, wherein the numbers of LEDs in at least two LED strings are different, and the LED numbers are arranged such that the total voltage of the LEDs in one LED string of the at least two LED strings is substantially the same as the total voltage of the LEDs in another LED string of the at least two LED strings.

2. The backlight control circuit of claim 1, wherein the current amounts passing through the at least two LED strings are different.

3. The backlight control circuit of claim 2, wherein the plurality of LED strings include LEDs of different colors, and the LEDs of different colors emit light sequentially.

4. The backlight control circuit of claim 3, wherein the illumination time periods in which the LEDs of different colors emit light are different for at least two of the plurality of LED strings.

5. The backlight control circuit of claim 1, further comprising:

a first circuit for extracting voltages from the plurality of LED strings, respectively, and selecting a lowest voltage thereof; and an error amplifier for comparing the output of the first circuit with a reference voltage, and outputting a signal to control the voltage supply circuit.

6. The backlight control circuit of claim 5, wherein the first circuit includes a plurality of sample-and-hold circuits to hold the extracted voltages.

7. The backlight control circuit of claim 5, wherein the first circuit includes a minimum voltage detection circuit for selecting a lowest voltage from at least two of its inputs.

8. The backlight control circuit of claim 5, wherein the first circuit includes a valley detection circuit for detecting and holding a lowest voltage within a period of time.

9. The backlight control circuit of claim 5, wherein the first circuit includes a multiplexer circuit for selecting one of the extracted voltages and inputting it to the valley detection circuit.

10. The backlight control circuit of claim 5, wherein the first circuit further includes an under current detection circuit for excluding a voltage lower than a third reference voltage from the extracted voltages.

11. A multi-color backlight control method, comprising:

supplying a single output voltage to a plurality of LED strings of different LED colors; and providing different numbers of LEDs in at least two of the plurality of LED strings of different LED colors;

wherein the LED numbers are arranged such that the total voltage of the LEDs in one LED string of the at least two LED strings is substantially the same as the total voltage of the LEDs in another LED string of the at least two LED strings.

12. The multi-color backlight control method of claim 11, further comprising: arranging the total numbers of LEDs of different colors so that brightness of different colors are substantially the same.

13. The multi-color backlight control method of claim 11, wherein the LEDs of different colors emit light sequentially.

14. The multi-color backlight control method of claim 13, wherein the illumination time periods in which the LEDs of different colors emit light are different for at least two of the plurality of LED strings of different colors.

15. The multi-color backlight control method of claim 11, further comprising: providing different amounts of current to at least two of the plurality of LED strings of different colors.

16. The multi-color backlight control method of claim 15, further comprising: providing at least two current sources to respectively control the amounts of current on the at least two LED strings of different colors.

17. The multi-color backlight control method of claim 11, further comprising:

extracting voltages from the plurality of LED strings of different LED colors;

selecting a lowest one of the extracted voltages; and controlling the output voltage according to the selected lowest voltage.

18. The multi-color backlight control method of claim 17, further comprising: sampling and holding the extracted voltage.

19. The multi-color backlight control method of claim 17, wherein the step of selecting a lowest voltage is to select a lowest one among the voltages extracted at the same time point.

20. The multi-color backlight control method of claim 17, wherein the step of selecting a lowest voltage is to select a lowest one among the voltages extracted within a time period.

21. The multi-color backlight control method of claim 17, further comprising: excluding a voltage lower than a reference voltage from the extracted voltages.

* * * * *